United States Patent [19]

Johnson

[11] 4,449,434

[45] May 22, 1984

[54] HOLE PUNCHING APPARATUS FOR THERMOPLASTIC FILM

[76] Inventor: James R. Johnson, 3819 Greenhill Dr., Chamblee, Ga. 30341

[21] Appl. No.: 367,690

[22] Filed: Apr. 12, 1982

[51] Int. Cl.[3] ..... B26D 7/10; B26D 7/18; B26F 1/12

[52] U.S. Cl. ..... 83/98; 83/16; 83/99; 83/133; 83/143; 83/171; 83/682; 83/695

[58] Field of Search ..... 83/16, 98, 109, 133, 83/134, 142, 143, 145, 171, 695, 99, 138, 139, 140, 137, 682

[56] References Cited

U.S. PATENT DOCUMENTS

| | | | |
|---|---|---|---|
| 1,839,544 | 1/1932 | Freeman | 83/143 X |
| 2,579,940 | 12/1951 | Lobrovich | 83/98 X |
| 3,075,573 | 1/1963 | Piazze | 83/171 X |
| 3,129,623 | 4/1964 | Lowell | 83/133 X |
| 3,368,441 | 2/1968 | Piazze | 83/682 X |
| 3,465,627 | 9/1969 | Vigneault | 83/171 |
| 3,719,736 | 3/1973 | Woodruff | 83/16 X |
| 4,206,667 | 6/1980 | Hirata et al. | 83/171 X |

*Primary Examiner*—E. R. Kazenske
*Assistant Examiner*—Taylor Ross
*Attorney, Agent, or Firm*—James B. Middleton

[57] ABSTRACT

Apparatus for cutting holes and notches in thermoplastic film by using heated steel rule dies. The dies are set into a heated die block, and scrap passes through the die, and through a hole in the heated die block so pieces of scrap fuse together as they pass through the block. The die block is fixed, and a movable platen urges the film down against the heated dies. A stripper is biased up to strip the film from the dies after cutting, and is resiliently movable down to allow cutting. Air can be directed through the stripper to blow the film up, off the stripper, to prevent melting when the film motion stops. Use of two dies accurately spaced can cut wicket holes and provide accurate cutting to assure proper operation in a bagging machine.

5 Claims, 6 Drawing Figures

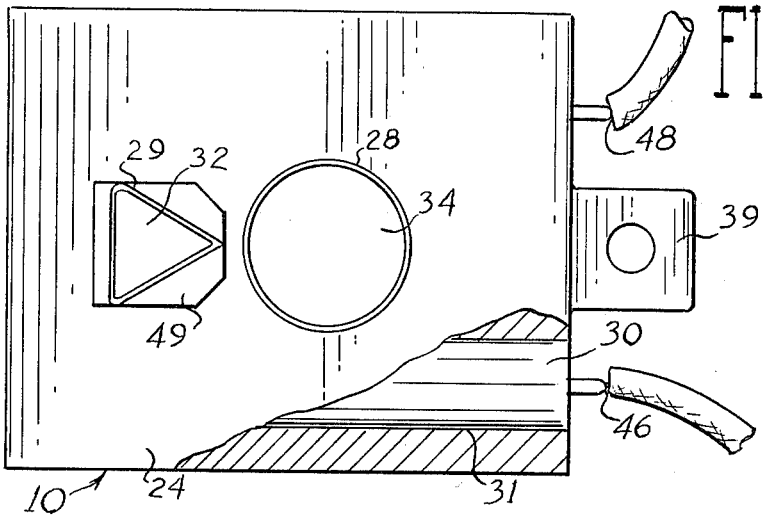
FIG. 2
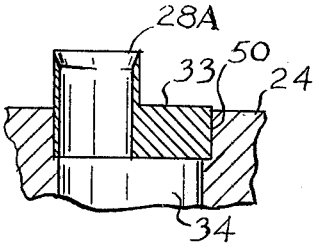
FIG. 3
FIG. 4
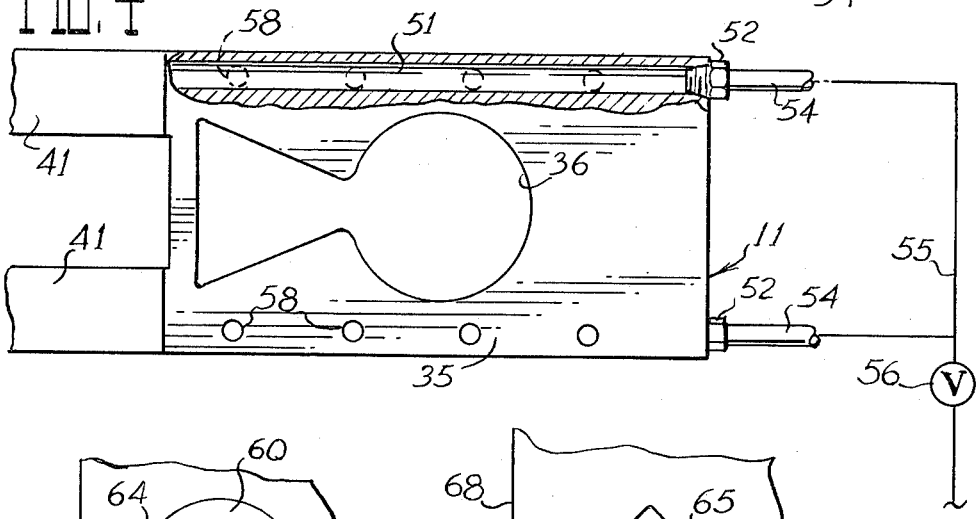
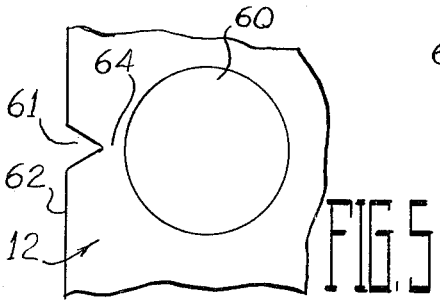
FIG. 5
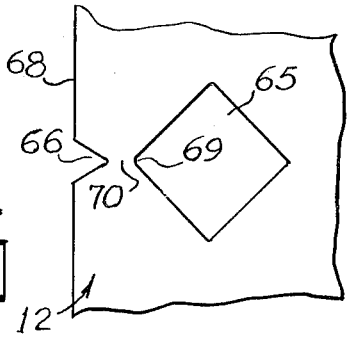
FIG. 6

HOLE PUNCHING APPARATUS FOR THERMOPLASTIC FILM

FIELD OF THE INVENTION

This invention relates generally to plastic film converting apparatus, and is more particularly concerned with apparatus for cutting holes and notches in film.

BACKGROUND OF THE INVENTION

There are innumerable instances in which one needs to provide one or more holes, notches or the like in a plastic film in the course of a converting process. In most cases, the tolerances on these holes are relatively broad, and the apparatus that has been used has been designed for high speed for great economy. The most frequent form of apparatus presently used for punching holes in plastic film includes a relatively large female die member with a toothed male cutter cooperable therewith. While such an arrangement is generally satisfactory, one cannot hold close tolerances with such a cutter, especially after the cutter has been used long enough that it becomes dull. In addition, such cutters are subject to the build-up of plastic thereon so that, with extended use, the cutter must be removed and cleaned.

It is currently a common practice to utilize plastic bags for packaging, the arrangement being such that a stack of plastic bags is held on a wicket, the top bag is opened by a blast of air, and the force of inserting goods into the bags rips the bag from the wicket. To accomplish this packaging method successfully, the bags are provided with a wicket hole at the top, with a slit extending from the top edge of the bag towards the wicket hole. With such an arrangement, it will be understood that the film remaining between the wicket hole and the slit is extremely important since the bag must stay on the wicket while the bag is opened, but must come off the wicket promptly when the goods are placed into the bag. With the prior art hole punching apparatus the wicket holes and slits can be punched sufficiently accurately while the cutters are sharp; but, when the cutters become dull and/or have plastic material built up on the edges of the cutters, there tends to be a stretching of the film before the film is cut. This results in a larger distance between the wicket hole and the slit so the bags do not always come off the wicket at the appropriate time during the packaging operation.

It will also be understood by those skilled in the art that, in the punching of holes in a plurality of bags being manufactured, there is a large quantity of scrap material in the form of small disks. While prior art punching apparatus utilizes waste chutes and bags in an attempt to contain the scrap material, the material is so light in weight and so subject to the accumulation of a static electric charge, that much of the scrap either misses the waste bin or sticks to some other portion of the machinery and becomes a problem both in the general clutter and in the interference with operation of machinery.

SUMMARY OF THE INVENTION

The present invention overcomes the above mentioned and other difficulties with the prior art method and apparatus for punching holes and the like by providing a heated steel rule die having the precise size and shape of the cut to be made in the plastic film. A platen is provided, and the film is guided between the die and the platen. At the appropriate time, the die and platen move relative to each other so that the steel rule die creates the appropriate opening in the film. In one successful embodiment, the steel rule die is stationary with a spring-urged stripper surrounding the die to strip the film from the die. The platen is moveable to urge the film towards the die against the spring tension of the stripper plate. A further advantage in this arrangement is that the steel rule die has an opening in the middle for receiving the scrap plastic film. Since the die is heated to a temperature above the melting point of the plastic film, the scrap melts at its edges so a plurality of the scrap disks fuse together into a mass that is easy to handle. One feature of the present invention is the use of the foregoing arrangement to provide wicket holes wherein two heated steel rule dies are provided, the space between the two dies determining the material to be torn when a bag is ripped off the wicket. Due to the accurate cutting of the steel rule dies, and the rigid placement of the steel rule dies, it will be understood that the amount of material to be torn will be precise in all bags. Furthermore, since the steel rule die cuts largely by means of heat, the problem of a dulled cutter is obviated.

BRIEF DESCRIPTION OF THE DRAWINGS

These and other features and advantages of the present invention will become apparent from consideration of the following specification when taken in conjunction with the accompanying drawings in which:

FIG. 2 is a top plan view of the heated die block with the steel rule dies as shown in FIG. 1 of the drawings;

FIG. 3 is a cross-sectional view showing a modified form of steel rule die mounted in the die block;

FIG. 4 is a top plan view, partially in cross-section, illustrating the stripper plate of the device shown in FIG. 1; and, FIGS. 5 and 6 are plan views showing two forms of wicket holes made in accordance with the present invention.

DESCRIPTION OF AN EMBODIMENT OF THE INVENTION

Figure 1:
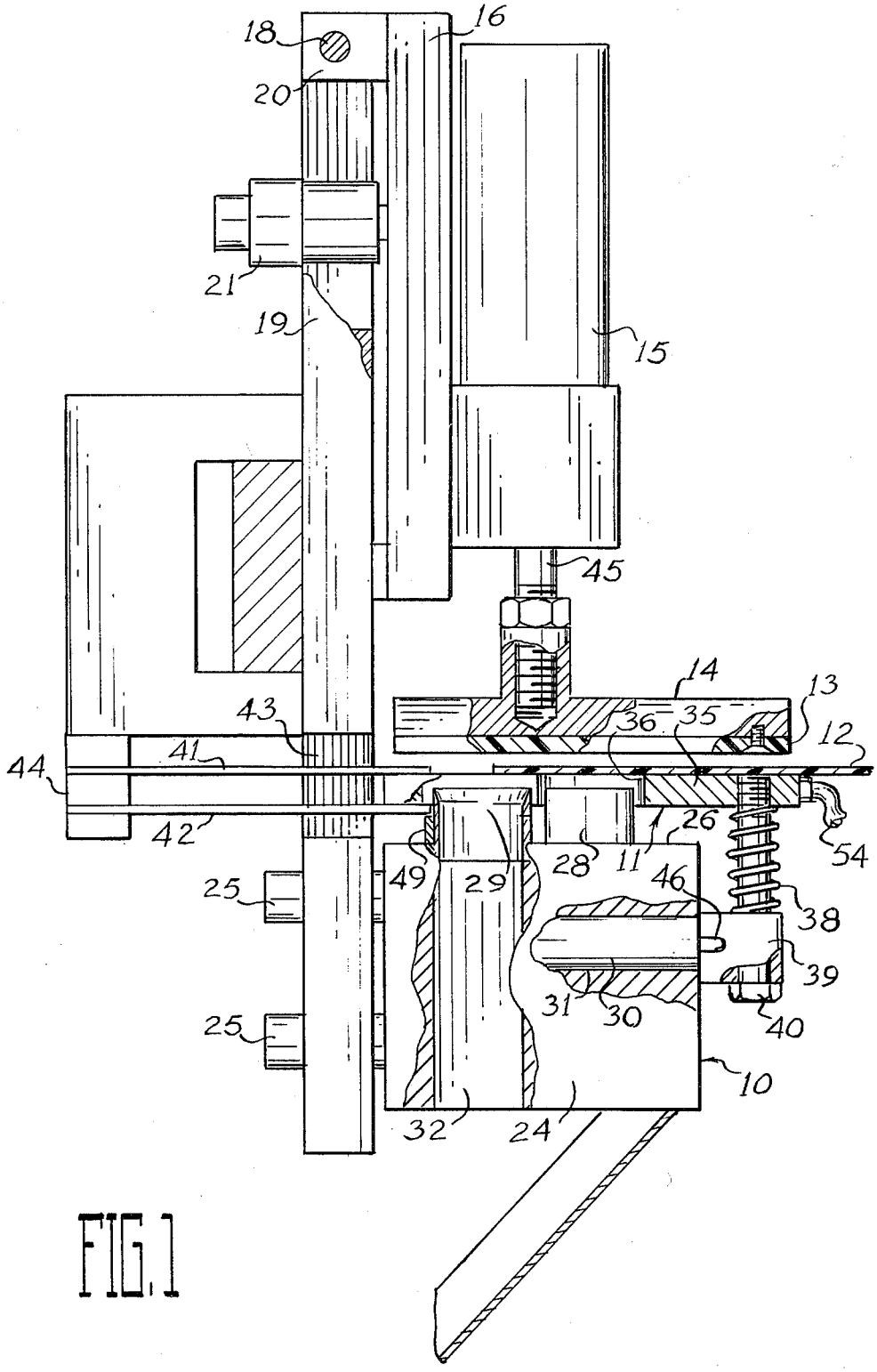
FIG. 1 is a side elevational view, partially in cross-section, showing one form of apparatus made in accordance with the present invention.

Referring now more particularly to the drawings, and to those emobdiments of the invention here presented by way of illustration, it will be seen in FIG. 1 of the drawings that there is a die retainer, or die block, 10 having a stripper 11 with the film 12 lying generally on the upper surface of the stripper 11. Above the film 12, there is a moveable platen 14 carried by a fluid operated cylinder 15.

The cylinder 15 is rigidly mounted to an arm 16, the arm being pivoted as at 18 from a vertical, bifurcated support 19. The arrangement is such that the ear 20 is fixed to the arm 16 and extends between the bifurcations of the vertical member 19. A latch 21 is also carried by the arm 16 and extends between the bifurcations of the member 19. When the cylinder 15 is in its operating position as shown in the drawings, the latch 21 can be rotated to prevent pivoting of the cylinder 15.

Attention is now directed to the die block 10 where it will be seen that the block 10 is a generally rectangular member or body 24 fixed to the vertical member 19 by means of a pair of screws 25 or the like. The upper surface 26 of the body 24 is appropriately recessed to receive the die or dies indicated at 28 and 29.

At this point, it will be understood that, while the method and apparatus of the present invention are useable virtually anytime a hole or notch needs to be cut into a film, the specific embodiment here presented is arranged for cutting wicket holes. It should further be noted that the prior art method and apparatus are somewhat satisfactory for providing wicket holes in conventional low density polyethylene and similar films because a sufficient number of holes can be punched before the cutters are too dull to punch accurately. On polyethylene film having a linear molecule and low density, the prior art method and apparatus are generally unsatisfactory. The linear-low-density film is exceptionally abrasive and causes the conventional cutters to dull very quickly. In conjunction with the dull cutters, the linear-low-density film is highly elastic and stronger so the holes punched with a dull cutter are completely unsatisfactory. Because the present method and apparatus utilizes a fixed cutting means and uses heat to cut the film, the present apparatus will cut linear-low-density polyethylene accurately with no problems after long use.

With the foregoing in mind, the two die members 28 and 29 are here shown in the body 24, the die 28 being arranged to cut the holes through which the wicket passes, and the die 29 being arranged to cut the notch to allow the hole to tear easily.

To heat the dies 28 and 29, the entire body 24 is heated. As here shown, there is an electric heater 30 received within an appropriate hole 31 in the body 24. As will be discussed hereinafter, and in the embodiment here presented, there are two such heaters in order to provide the needed quantity of heat.

It will also be seen in FIG. 1 of the drawings that the die 29 is mounted in the body 24, and a scrap passage 32 extends from the die 29 completely through the body 24. Because of this arrangement, it will be understood that the film 12 will be pressed against the die 29 and a piece of scrap material will remain within the confines of the die 29. Since the die 29 is above the melting temperature of the plastic film 12, the piece of scrap material will melt away from the edges of the die and fall into the hole 32. It will be understood that, as successive pieces of scrap are passed into the die 29, the edges of successive pieces of scrap will be molten so that the edges of the scrap will stick together. This process of adding scrap disks, and continuously melting the edges of the scrap, causes the edges to stick together and form a generally continuous chain of scrap disks that will pass through the passageway 32. In use, the scrap tends to stick together until there is sufficient weight that the chain is broken by the weight of the material. The scrap is therefore held together in a convenient bundle, and can be readily processed for recycling.

As shown in FIG. 1 of the drawings, the stripper 11 is shown in its upper position. It will be seen that the stripper 11 comprises a generally rectangular plate 35 having an opening 36 to receive the dies 28 and 29 therethrough.

One end of the stripper 11 is urged upwardly by a spring 28 acting between the plate 35 and a boss 39 and threadedly received into the plate 35 of the stripper 11. The spring 38, then, acts between the plate 35 and the boss 39 to maintain the plate 35 in its uppermost position.

The opposite end of the plate 35 is also resiliently urged to the upper position. While an arrangement similar to that just discussed may be used in some installations, the arrangement here shown includes a pair of leaf springs 41 and 42, the leaf spring 41 being fixed to the upper surface of the plate 35 while the leaf spring 42 is fixed to the lower surface of the plate 35. The leaf springs 41 and 42 then extend outwardly beyond the member 19 to be carried by a block 44, the ends of the springs 41 and 42 being held rigidly in the block 44.

With the above described arrangement, it will be understood that the leaf springs 41 and 42 act somewhat as a parallel linkage, maintaining the plate 35 in a horizontal attitude. While there would theoretically be a rotational motion about the block 44, it will be seen that the total travel of the plate 35 is so small that the movement of the plate 35 towards the member 19 is negligible.

The platen 14 includes a rigid member of metal or the like carried by the piston rod 45 of the cylinder 15. Since the lower surface of the platen 14 will be engaged by the heated dies 28 and 29, the lower surface is preferably covered with a heat-resistant material to which the film will not readily stick. An excellent material for this purpose is a polytetrafluoroethylene. As here shown, there is a block of such material, for example "Teflon", removeably fixed to the metal platen 14. Though easily releasable fastening means may be used to hold the block 13 for easy replacement, it has been found that a block has a very long life, and relatively permanent attachment is acceptable.

From the foregoing discussion, it will now be understood by those skilled in the art that the film 12 is held in place by conventional equipment not here illustrated, usually by being passed over a roll at each side of the apparatus herein described. The film 12 is arranged to lie approximately along the upper surface of the stripper 11 when the stripper 11 is in its uppermost position.

When the film 12 is in position to be cut, the apparatus will be activated and the cylinder 15 will project its rod 45 to urge the platen 14 with the block 13 down against the film 12, and continue to push the film 12 down against the spring tension of the stripper 11 to cause the film 12 to engage the heated dies 28 and 29. A mere touching of the dies 28 and 29 against the surface of the platen 14 is all that is required to perform the cut, so the platen 14 is immediately withdrawn by reversing the cylinder 15. When the film 12 is released, the film is advanced by the conventional mechanism, and the cycle is repeated.

Looking at FIG. 2 of the drawings, it will be seen that the die block 10 is illustrated, the block being partially broken away to show the heater 30 with the electrical connection 46. Also, the electrical connection 48 for the second heater for the die block 10 is shown.

In FIG. 2, the configuration of the die members 28 and 29 is shown better. Here, it will be seen that the die 28 is a circular steel rule die set directly into the body 24. There is a hole 34 extending completely through the die 28 and through the body 24 so scrap will pass completely through the body 24 as was previously described.

The die member 29 is shown as mounted in a die carrier 49, the die carrier 49 being, in turn, mounted into the body 24. While it will be obvious that the die 29 could be mounted the same as the die 28, it will be understood that a hole must be provided in the body 24 to fit the die precisely. By using a die carrier 49, a single hole can be provided in the body 24 and different die carrier can be provided for slight variations in the die member.

A variation on the die 28 is shown in FIG. 3 of the drawings. The opening 34 is provided through the body 24, but the die itself indicated at 28A is of a smaller diameter than the hole 34. The die 28A is therefore formed with a base 33 having a diameter equal to the die recess 50, and the die itself is of a smaller diameter.

Also in FIG. 3, it will be noted that the outside diameter of the die has the sharp edge, the die being sharpened from the inside only, to provide a chisel-type cutting edge. This arrangement is used so that the outer diameter of the die provides the appropriate diameter for the hole in the plastic film, and the scrap can be melted by the sloped surface and pass through the inside of the die.

Looking briefly at FIG. 1 of the drawings, it will be realized that, if the motion of the film 12 is stopped, the thermoplastic film will be closely adjacent to the heated dies 28 and 29, and in close proximity to the heated body 24. In order to prevent plastic build-up on the dies 28 and 29, the temperature of the body 24 will be in the vicinity of 600° Fahrenheit. During the operation of the device, the film 12 is moving rapidly enough that excess heat is carried off and the film is not melted except for the precise cuts being made by the dies. If the apparatus is stopped for any reason, the film 12 will be close enough to the heated body 24 and dies 28 and 29 that the film will melt. To prevent this undesirable melting, the stripper 11 is provided with air passages through which air is passed anytime the apparatus stops.

Looking at FIG. 4 of the drawings, the arrangement here shown by way of example includes a pair of longitudinal passages 51 having fittings 52 connected to tubings 54. The tubings 54 are connected to a line shown schematically at 55 and containing a valve 56. While not here illustrated, it is contemplated that the valve 56 would be electrically controlled and arranged to open every time the switch to the main apparatus is turned off. This will cause an automatic supply of air to the tubes 54 when the motion of the film 12 is stopped. When air enters the tubes 54, it will be seen that air will travel down the longitudinal passages 51 and pass upwardly, out the holes 58 which are shown in phantom on one side of the plate 35 and in full lines on the other. The air will therefore both cool the stripper 11 and hold the film 12 slightly above the plate 35. It will be understood that the flow of air through the holes 58 and across the film 12 will also be sufficient to carry off the radiant heat from the heated die block 10.

Looking further at FIG. 4 of the drawings, it will be noticed that the opening 36 in the plate 35 of the stripper 11 is shaped to conform to the dies 28 and 29. Though the shape of the hole 36 is similar to the shape of the dies, the hole is larger to allow an easy fit and no reasonable chance for binding film between a die and the stripper 11.

Also, it will be seen that there is a pair of leaf springs 41 and 42. With reference to FIG. 1 of the drawings, it will be understood that one leaf spring 41 passes on one side of the member 19, and another leaf spring 41 passes on the other side of the member 19. The member 19 is appropriately notched at 43 to allow the required clearance.

Attention is next directed to FIG. 5 of the drawings, where there is shown an edge of a piece of plastic film 12, the film having a wicket hole 60 therein. It will be seen that the wicket hole 60 is a circular hole as is conventional in the art, or as may be punched by the die 28.

In conjunction with the wicket hole 60, it will be seen that there is a notch 61. The conventional wicket hole would use a slit in lieu of the notch 61 in order to diminish the amount of material between the wicket hole 60 and the edge 62 of the film 12; however, by utilizing a die member such as the die 29, it will be understood that the notch 61 will be cut.

In any event, the important feature is the amount of material, indicated at 64, that must be torn in order to rip the film 12 from the wicket. Considering the die arrangement, especially as is shown in FIG. 2 of the drawings, and the general method and apparatus herein disclosed, it will be understood that the material 64 will be precisely the same for every wicket hole punched. Due to the arrangement herein utilized, there is no possible stretching or the like of the film 12, and the use of heated steel rule dies assures a clean and uniform cut every time.

Because of the arrangement herein contemplated, it is not necessary to use a circular wicket hole such as the wicket hole 60. Since the die such as the die 28 can be made in any desired shape, the wicket hole can be any desired shape.

It will be understood that, using a circular wicket hole such as the wicket hole 60, the wicket may be positioned at a point along the circular opening 60 that is not precisely along the diameter that includes the apex of the notch 61. In this event, it will be understood that the stresses on the material 64 are somewhat different and there may be, effectively, a greater amount of material to be torn.

To locate the wicket more accurately, it may be desirable to utilize a different shape of hole that would tend to locate the wicket at the desired point. FIG. 6 of the drawings shows one possible shape, which is a diamond-shaped hole 65. Opposite the diamond-shaped wicket hole 65, there is a notch 66 in the edge 68 of the film 12; and, it will be seen that the apex of the notch 66 is adjacent to the apex 69 of the wicket hole 65.

Because the wicket hole 65 has straight sides defining the apex 69, it will be understood that the film 12 will tend to shift until the wicket wire is in the apex 69. The material 70 to be torn will then always be the same, which is between the apex 69 of the wicket hole 65 and the apex of the notch 66.

While a diamond-shaped wicket hole 65 is here illustrated, it will be understood that the important feature is the use of sharply tapered sides leading to the apex 69, and other shapes of holes would function as well. For example, one may wish to use a triangle, an elipse, or another shape selected both for its function and its decorative appearance.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. Apparatus for punching holes and the like in thermoplastic film comprising a steel rule die having an upwardly facing cutting edge, die heating means for heating said die, a platen above said die for selective engagement with said die, and means for moving said platen towards said die, said die heating means including a die block for carrying said die, and heating means for heating said die block, said die defining an opening therein to receive scrap cut from thermoplastic film, said die block defining an opening therein for allowing said scrap to pass through said die block, said die block and said die being heated to a temperature above the melting temperature of said scrap, a stripper between said die and said platen, said stripper defining an opening therein sufficient to receive said die therethrough, spring means for biasing said stripper to a position above said die block, the arrangement being such that said thermoplastic film normally lies along the upper surface of said stripper and said film is moved into contact with said die by said platen, said stripper defining an air passage therein and a plurality of holes connecting said air passage with said upper surface of said stripper, and air supply means for selectively passing air through said air passage, out said plurality of holes, and against said film for lifting said film from said upper surface of said stripper and for cooling said stripper and said film.

2. Apparatus as claimed in claim 1, and further including a second steel rule die mounted in said die block, said steel rule die being arranged to cut a wicket hole, said second steel rule die being arranged to cut an edge of the film adjacent to said wicket hole, said second steel rule die being heated by contact with said die block and being engageable by said platen, said steel rule die and said second steel rule die being fixed to said die block with a predetermined distance therebetween, both said steel rule die and said second rule die being formed with vertical outside edges and beveled internally for maintaining said predetermined distance.

3. Apparatus as claimed in claim 2, said second die including a die carrier receivable in said die block, said steel rule die being carried by said die carrier.

4. Apparatus as claimed in claim 2 wherein said wicket hole defines an apex for receiving a wicket and accurately positioning said wicket.

5. Apparatus as claimed in claim 4 wherein said second die is arranged to cut a notch having an apex adjacent to said apex of said wicket hole.

* * * * *